United States Patent [19]

Brown

[11] 4,161,150

[45] Jul. 17, 1979

[54] SIMPLIFIED ACTUATION OF TWO STEP BUTTONHOLE IN ELECTRONICALLY CONTROLLED SEWING MACHINE

[75] Inventor: Jack Brown, Union, N.J.

[73] Assignee: The Singer Company, New York, N.Y.

[21] Appl. No.: 954,017

[22] Filed: Oct. 23, 1978

[51] Int. Cl.[2] ..... D05B 3/06; D05B 3/02

[52] U.S. Cl. ..... 112/158 E; 112/158 B

[58] Field of Search ..... 112/158 E, 158 B, 121.11, 112/65, 264

[56] References Cited

U.S. PATENT DOCUMENTS

| | | | |
|---|---|---|---|
| 3,060,875 | 10/1962 | Iida | 112/158 B |
| 3,137,256 | 6/1964 | Fujita | 112/158 B |
| 3,754,521 | 8/1973 | Thuring | 112/158 B |
| 3,977,338 | 8/1976 | Wurst et al. | 112/158 E X |
| 3,987,739 | 10/1976 | Wurst et al. | 112/158 E |

*Primary Examiner*—Peter Nerbun

*Attorney, Agent, or Firm*—Edward P. Schmidt; Robert E. Smith; Edward L. Bell

[57] ABSTRACT

An electronically controlled sewing machine having buttonhole capability and a reverse stitch actuating switch wherein actuation of the reverse switch during a buttonholing operation will initiate the second step of the buttonhole. Signals characteristic of selection of a buttonhole mode of operation are used in a logic combination to enable reverse selecting means to be used to initiate the second step of the buttonhole while inhibiting its use to implement reverse stitching. Absence of these characteristic signals will permit the reverse selecting means to be used to implement reverse stitching.

4 Claims, 3 Drawing Figures

SIMPLIFIED ACTUATION OF TWO STEP BUTTONHOLE IN ELECTRONICALLY CONTROLLED SEWING MACHINE

DESCRIPTION

BACKGROUND OF THE INVENTION

This invention is in the field of sewing machines; more specifically, an electronically controlled sewing machine having the capability of producing a buttonhole in two steps where the length of the buttonhole is visually controlled by an operator.

It is known in the prior art to have a sewing machine complete a buttonhole in four steps, one step for each of the bars and the legs of the buttonhole. It is also known in the prior art to make a sewing machine, at somewhat increased manufacturing cost, capable of producing a buttonhole in two steps consisting each of a barring stitch and a leg. The prior art also teaches sewing machines having the capability to produce a buttonhole in one step without further operator intervention once initiated, however at still further manufacturing cost and generally requiring a special purpose buttonholing presser foot and careful initial operator preparation. The use of a sewing machine having the capability for one step buttonholing offers many advantages particularly when a garment being operated upon requires the stitching of many identical buttonholes. However, the greatly increased manufacturing costs of such a one step buttonholing machine and the requirement for a relatively expensive special purpose buttonholing foot will, in many cases, outweigh the convenience thereby attained. For many sewing machine operators, a sewing machine having the capability of performing a buttonhole in two steps is an attractive compromise between the much more expensive sewing machine having a one step buttonholing capability, and the slightly less expensive, but more tedious operations required of a sewing machine having the capability to perform a buttonhole in four steps.

In the prior art sewing machines having the capability to perform buttonholes in two steps, provision must be made for operator initiation of the second step of the buttonhole. In many of the prior art machines, such as is shown in U.S. Pat. No. 3,754,521 of Thuring, a special control is provided operative only for initiating the second step of the buttonhole. In the U.S. Pat. No. 3,060,875 of Iida, actuation of the second step of the buttonhole is implemented by depression of the reverse button which has previously been rotated 90° in order to present a cam surface part of the reverse button to a lever arrangement of the bight controlling mechanism so that opposite side stitches of a buttonhole will be initiated. However, the construction disclosed in the last cited patent is effective only to accomplish a four step buttonhole and, further, is susceptible of erroneous operation in normal sewing and buttonhole stitching because of the required 90° rotation of the reverse button in order to accomplish buttonhole stitching.

In an electronically controlled sewing machine, such as is shown in U.S. Pat. No. 3,977,338 of Wurst et al, one step buttonholing is accommodated by the use of a presser device, as shown in the U.S. Pat. No. 3,877,403 of Ketterer, used in conjunction with a lever device, as shown in the U.S. Pat. No. 3,841,246 of Casner et al, modified, however, to accommodate a switch device for automatically signaling the electronics of the sewing machine at the termination of the first step of the buttonhole. In order to accommodate the two step buttonhole in the prior art electronically controlled sewing machines it has been necessary for an operator to manually manipulate the tripping rod lever shown in the U.S. Pat. No. 3,841,246 in order to initiate the second step of a two step buttonhole. Unfortunately, the two step buttonholing thus accommodated in an electronically controlled sewing machine was somewhat inconvenient to the use of an operator, was somewhat hazardous and, still required the addition to the sewing machine of some of those parts necessary to accommodate one step buttonholing.

What is required is an electronically controlled sewing machine of economic construction for two step buttonholing capability which is not susceptible of erroneous operation and will not increase the hazard to the operator or to damage of work material.

SUMMARY OF THE INVENTION

The above desired ends are achieved in an electronically controlled sewing machine which is not required to include those parts necessary for the performance of a one step buttonhole. The electronically controlled sewing machine includes a selection system by way of which a specific selection may be made of, for example, straight stitch, reverse stitch, various patterns or buttonholes. The reverse stitch is effected by a switch which, while it remains closed will provide a logic "zero" to an auxiliary unit, signaling that unit to interrupt utilization of pattern information and to substitute in its place information to influence uniform work feed in a reverse direction. An address counter, which provides an address to a ROM for release of selected information therefrom, is responsive to a momentary change to a logic "zero" to initiate output of addresses of the second half of a buttonhole, if the sewing machine is operating in a buttonhole mode. Logic is provided to recognize selection of a buttonhole mode of operation. During selection of a buttonhole mode of operation the reverse switch is effective to cause the address counter to initiate the second half of the buttonhole. If a buttonhole mode of operation is not selected, and the reverse switch is acutated, transistor logic is provided to provide a logic "zero" to the auxiliary memory unit to enable the output of reverse stitch information therefrom.

DESCRIPTION OF THE DRAWINGS

The accompanying drawings illustrate a preferred form of the invention in which.

DESCRIPTION OF THE PREFERRED EMBODIMENT

Figure 1:
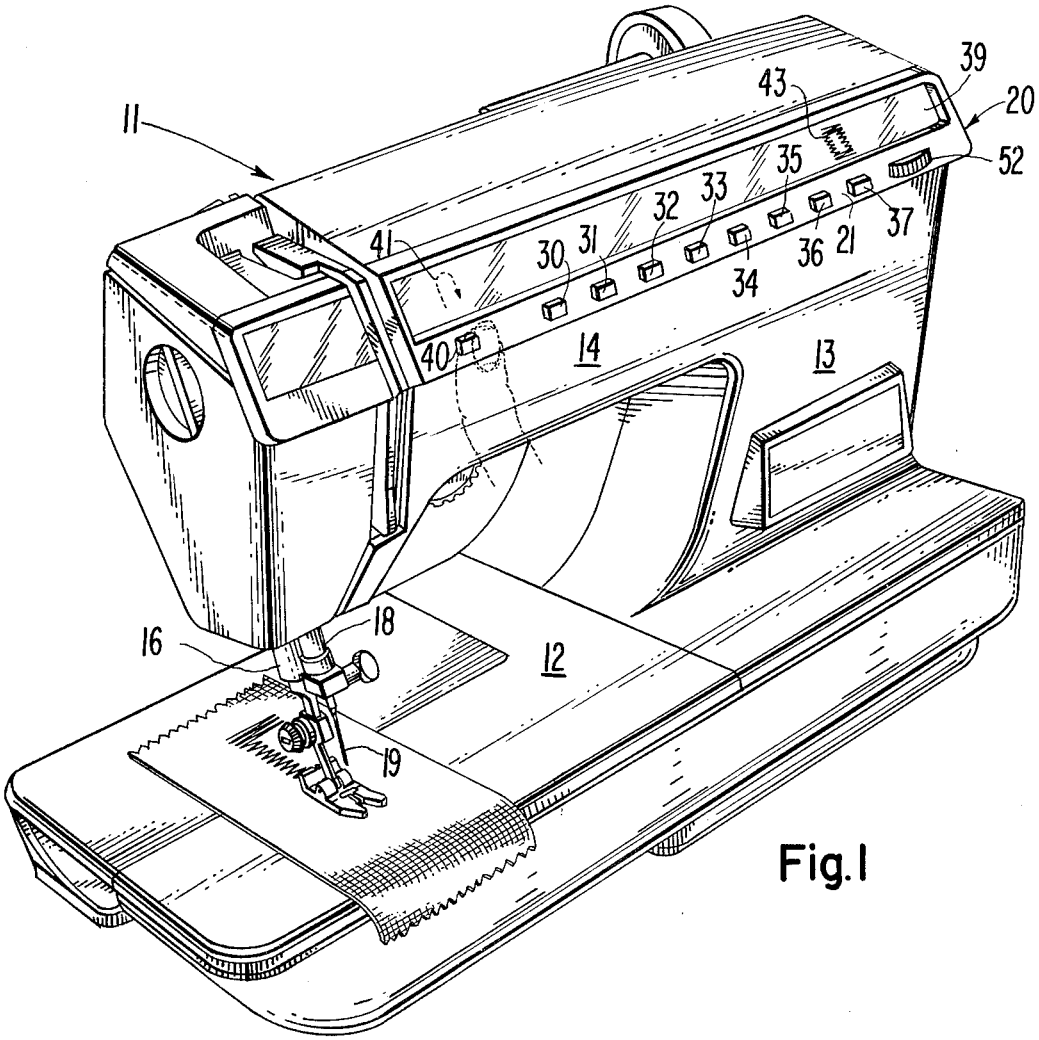
FIG. 1 is a front perspective view of a sewing machine to which this invention has been applied.

Referring to FIG. 1 of the drawings, 11 indicates a sewing machine including a work supporting bed 12 from which rises a standard 13 which sustains a bracket arm 14 overhanging the bed. A throat plate (not shown) carried on the bed 12 supports the thrust of a spring loaded presser device 16 carried in the bracket arm 14. Work fabrics to be stitched are urged by the presser device 16 downwardly against the throat plate and against a work feed dog (not shown) which works upwardly through slots in the throat plate to feed the work in a manner well known in the sewing machine art. In addition to the presser device 16 the bracket arm 14 also supports therein an endwise reciprocating needle bar 18 terminating in a sewing needle 19.

The bracket arm of the sewing machine is preferably fitted with a control assembly 20 which may be constructed in accordance with that disclosed in U.S. Pat. No. 3,913,506 of Adams et al, which is assigned to the same assignee as the instant invention and which is hereby incorporated by reference herein. Preferably, the control assembly includes an escutcheon plate 21 through which a plurality of selector buttons 30 to 37 protrude, and a transparent insert 39 through which indicia in close association with the selector buttons is visible. Selector button 30 may be used to select straight stitch operation in the forward direction, while buttons 31 to 37 may each be associated with a group of patterns. An additional button 40 is provided shiftably supported to protrude through the escutcheon plate 21 for the purpose of manually influencing reverse stitching. Suitable indicia 41 may be arranged on the transparent insert 39 above the feed reversing button 40 to identify the purpose of this button for machine operator. Also shown in FIG. 1 is the buttonhole indicia 43 positioned above the selector button 37.

Figure 2:
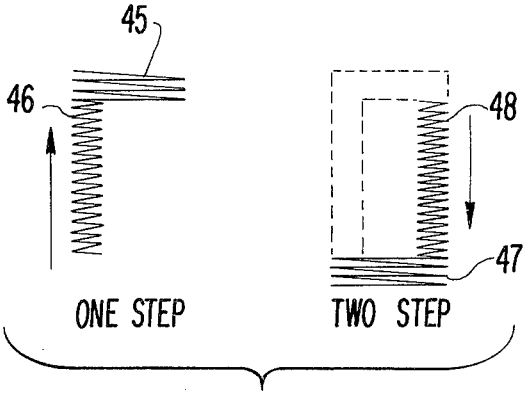
FIG. 2 is a diagrammatic view of step one and step two and a two step buttonhole which may be made on the machine shown in FIG. 1; and, FIG. 3 is a logic and block diagram of the sewing machine shown in FIG. 1 to which the elements of this invention for accomplishing the two step buttonhole of FIG. 2 have been applied.

Referring now to FIG. 2, there is shown the two steps required to generate a complete buttonhole. In step one, a first bar tack 45 and one leg 46 of the buttonhole are generated in a forward stitch direction, with the fabric moving in the direction of the arrow. When the first leg 46 of the buttonhole is of the proper length, an indication may be made to the electronically controlled sewing machine 11 which will initiate the second bar tack 47 and the second leg 48 of the buttonhole in the reverse direction. Since the second step of the buttonhole is actuated by the sewing machine in the reverse direction it would be most advantageous if the reverse selector button 40 was able to initiate the second step after a determination had been made by way of pattern selector button 37 to stitch a buttonhole. The use of the reverse selector button 40 in this fashion is highly convenient in as much as this selector button is located closer to the stitching area within the line of sight of an operator and since the second step is implemented in the reverse direction. To accommodate the use of the reverse selector button 40 to accomplish its usual function of reverse stitching as well as to initiate the second step of a buttonhole will require modifications to the electronic circuitry of the sewing machine as will be described below.

Figure 3:
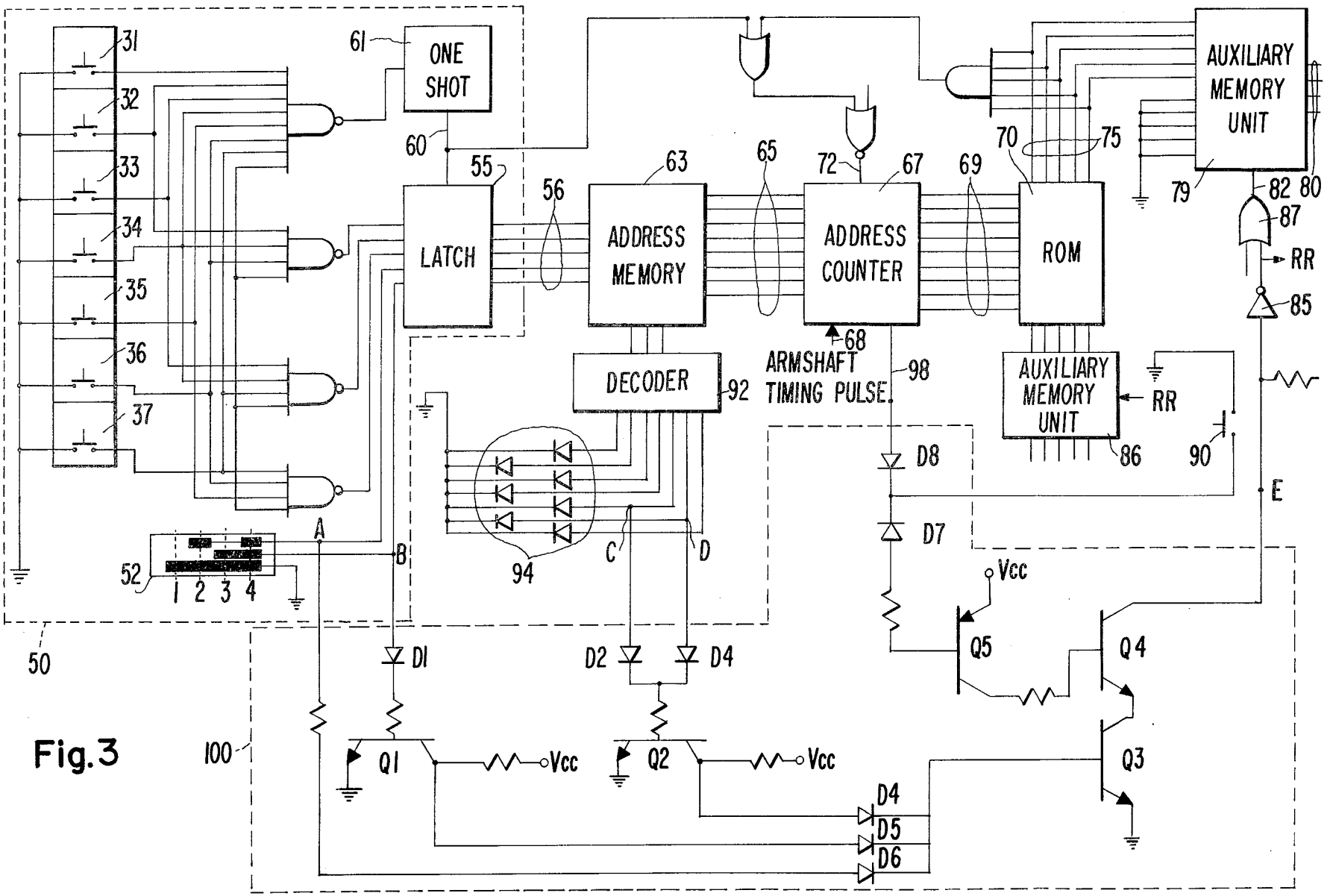

FIG. 3 is a circuit diagram of the sewing machine to which this invention has been applied. The basic sewing machine is similar to that described in the U.S. Pat. No. 3,977,338 issued on Aug. 31, 1976 to Wurst et al, which is assigned to the same assignee as the instant invention and is hereby incorporated by reference herein. The above patent may be referred to in order to obtain a better understanding of an electronically controlled sewing machine so as to better appreciate how any specific electronically controlled sewing machine must be modified in order to incorporate the invention therein. That portion of the diagram of FIG. 3 within the dashed line 50 refers to the pattern selection system, a greater understanding of which may be attained from U.S. Pat. No. 3,913,506 issued on Oct. 21, 1975 to Adams et al, which is hereby incorporated by reference herein. This patent discloses how the seven pattern selector buttons 31–37 and a group selector switch 52 may be manipulated in order to call up from a static memory one of 28 patterns. The pattern selection system 50, depending upon the setting of a group selector switch 52 and depending upon which pattern selection button 31–37 is depressed, results in appearance of a selected digital code signal continually on output lines 56 from the latch 55 and also results in a pulse generated in the line 60 from the one shot 61 to lock the latch. In an address memory 63, a digital code signal input on lines 56 results in output on lines 65 which continuously defines the starting word address of a group of word addresses in the pattern ROM 70 constituting a stitch pattern. An address counter 67 is responsive to pulses on line 68 to increase the address appearing on lines 69 leading to the ROM 70. A pulse on line 72 leading to the address counter is required to reset the counter to the starting word address appearing on line 65 and this was occasioned by a pulse on line 60 resulting from selection of a new pattern or upon appearance of a special end of pattern code word on the output lines 75 from the ROM 70.

It will be observed that the bight output lines 75 do not lead directly from the pattern ROM 70 to the bight actuating means, but are instead directed to an auxiliary memory unit 79. The auxiliary memory unit 79 stores one pattern of stitch bight information corresponding, for instance, to center needle position, which is applied to output line 80 leading to actuating means such as a linear actuator whenever a signal is applied to the line 82 leading to the auxiliary memory unit. In the absence of a signal on line 82, the auxiliary memory unit 79 will pass to the lines 80 the stitch pattern information received as input thereto on lines 75.

As illustrated, the output side RR of an inverter 85 is connected as an input to an OR gate 87 of which the output is connected to the signal line 82 of the auxiliary memory unit 79. Normally, in this arrangement, a feed reversing switch 90, actuated by reverse selector button 40, would be directly connected to the inverter 85 so that upon depression of the feed reversing switch, the needle will be shifted to a given fixed lateral position, preferably to center needle position. The output RR of the inverter 85 is also applied to an auxiliary memory unit for feed 86 which stores stitch feed information corresponding to a reverse stitch and which operates identically to the auxiliary memory unit for bight 79. Thus, in the prior art device, a feed reverse could be obtained which would provide straight stitch in the reverse direction regardless of which pattern had been selected for actuation by the sewing machine.

The address memory 63 is, in addition to the above, connected to a decoder 92, to which in turn are connected LED's 94. Depending upon the address supplied by the address memory 63 to the decoder 92 specific of the LED's 94 are illuminated to indicate which of the selector buttons 30–37 and 40 have been depressed. As stated above, each of the pattern selector buttons 31–37 may select one of four patterns depending upon the selected one of the four attainable positions by the group selector switch 52. Where, for example, two different types of buttonholes are provided for, they may be selected by depressing two different pattern selection buttons 31–37 while maintaining the group selector switch 52 in position two, for example. In position two, the output from the group selector switch 52 would be in logic zero at point A and a logic one at point B. If a buttonhole mode of operation has been chosen by selection of, for example, pattern selector button 36 or 37, the LED 94 at point C or point D would have been activated. Thus, in the buttonhole mode of operation, point A is a logic zero, point B is a logic one and either point C or point D is a logic one. A logic combination may be constructed as shown within the dashed lines 100, which will recognize these states at points A and B, and C or D in order to recognize the selection of a buttonhole mode of operation.

The address counter 67 has a second input on line 98, which upon a momentary change from a logic state one to a logic state zero initiates the second step of a two step buttonhole operation if the machine is operating in a buttonhole pattern mode. For each leg of the buttonhole only two stitch coordinates are required, the last of which contains an instruction to go back to read the previous stitch coordinate. In this fashion buttonholes of variable length may be formed. This instruction is contained in a control bit which is a logic "1" for a request to read a previous stitch, and a logic "0" for an instruction to continue on to the next succeeding address. Thus, a logic "0" on line 98 will terminate the first leg of the buttonhole and initiate the second step thereof. Thus, by connecting the feed reversing switch 90 to line 98 through an isolating diode D8, operation of the reversing switch in the buttonhole mode of operation will provide a momentary change from logic state 1 to logic state 0 which will initiate the second step of the buttonhole.

Returning once again to the logic combination, enclosed by dashed line 100, the buttonhole mode of operation is indicated by the logic 0 at point A, a logic 1 at point B and a logic 1 at either point C or point D. A logic state 1 at point B causes transistor Q1 to conduct creating a logic state 0 at isolating diode D5. A logic state 1 at point C or point D will cause transistor Q2 to conduct also creating a logic state 0 at isolating diode D4. Thus, isolating diodes D4, D5 and D6 are at logic state 0 and transistor Q3 is non-conducting. In this event, momentary operation of reverse switch 90 will create a momentary change from logic state 1 to a logic state 0 on line 98 to the address counter 67, thereby initiating the second step of a two step buttonhole operation. Also, momentary operation of the reverse switch 90 will cause transistor Q5 to conduct, which in turn will cause transistor Q4 to conduct. However, since transistor Q3 is non-conducting, point E remains at logic state 1 and the auxiliary memory units 79, 86 will not initiate a reverse straight stitch. If, on the other hand, points B or C and D are at logic state 0 or point A is at logic state 1, a logic state 1 will exist at isolating diodes D4, D5 and D6. A logic state 1 on the base of transistor Q3 will cause Q3 to conduct, thereby placing point E at logic state 0 and initiating reverse straight stitching when the reverse switch 90 is actuated in as much as the sewing machine is not in a buttonhole mode of operation.

Thus, the reverse switch 90 is effective to cause conduction of transistor Q4. If a non-buttonhole mode of operation has been selected as determined by the logic states at A, B and C or D, the presence of a logic state 1 on the collector of transistor Q3 will cause that transistor to conduct and thus upon depression of a reversing switch 90 the point E will go to a logic state 0 and initiate reverse straight stitching. If, however, a buttonhole mode of operation has been selected, a logic state 0 on the collector of transistor Q3 will cause that transistor to be non-conducting so that point E will remain at logic state 1, and the data in the auxiliary memory units 79, 86 relative to reverse straight stitching will not be released to the actuators of the sewing machine. However, in that event, operation of the reverse switch 90 will initiate the second step of a two step buttonhole by means of the connection via line 98 to the address counters 67. The address counter 67 will be responsive to a signal by way of line 98 only during a buttonhole mode of operation.

I claim:

1. An electronically controlled sewing machine having stitching instrumentalities; actuators for positioning said stitching instrumentalities in the formation of a sequence of stitches; a first logic device including at least one memory device containing sequential stitch information for release to said actuators, including information for reverse stitching; a selector means for retrieving selected stitch information from said memory device, said selector means including means for selecting at least one form of a buttonhole and means for selecting reverse stitching; said first logic device being responsive to selection of said at least one form of a buttonhole to release sequential stitch information from said memory device to said actuator of a first step of said buttonhole beginning with a first end thereof and terminating in a series of inner and outer stitches of a first leg thereof, said first logic device being further responsive to an extraneous signal to terminate the release of stitch information of said inner and outer stitches of said first leg, and to initiate the release of sequential stitch information from said memory device to said actuators of the second step of said buttonhole beginning with a second end thereof and terminating in a series of inner and outer stitches of a second leg thereof; wherein the improvement comprises:

means for connecting said reverse selecting means to said first logic device as a generator of said extraneous signals and as a reverse stitch selector; and, means responsive to selection of said means for selecting at least one form of a buttonhole for enabling operation of said reverse selecting means as a generator of said extraneous signal and responsive to non-selection of said buttonhole selecting means for enabling operation of said reverse selecting means to effect reverse straight stitching.

2. An electronically controlled sewing machine as claimed in claim 1 wherein said connecting means is implemented by a second logic device responsive to signals from said selector means characteristic of selection of said at least one form of a buttonhole to inhibit operation of said reverse selector means as a means to effect reverse straight stitching.

3. An electronically controlled sewing machine as claimed in claim 2 wherein said second logic device includes at least one transistor placed in a non-conductive state by said signals characteristic of selection of at least one form of a buttonhole.

4. An electronically controlled sewing machine as claimed in claim 3 wherein said transistor in response to said signals other than those characteristic of selection of said at least one form of a buttonhole establishes a connection between a signal source and at least one memory device for release of stitch information for reverse stitching.

* * * * *